United States Patent [19]

Fortgens

[11] Patent Number: 4,493,478

[45] Date of Patent: Jan. 15, 1985

[54] JACK

[75] Inventor: Walter Fortgens, Gothenburg, Sweden

[73] Assignee: AB Volvo, Gothenburg, Sweden

[21] Appl. No.: 445,833

[22] Filed: Nov. 30, 1982

[30] Foreign Application Priority Data

Dec. 8, 1981 [SE] Sweden ..... 8107336

[51] Int. Cl.[3] ..... B66F 3/00

[52] U.S. Cl. ..... 254/126; 74/424.8 R

[58] Field of Search ..... 254/126; 74/89.15, 424.8 R; 248/422; 411/8, 9, 432, 433, 911

[56] References Cited

FOREIGN PATENT DOCUMENTS 2175532 10/1973 France .
2300039 3/1976 France .
392708 4/1977 Sweden .

*Primary Examiner*—James G. Smith
*Assistant Examiner*—Judy J. Hartman
*Attorney, Agent, or Firm*—Young & Thompson

[57] ABSTRACT

A jack comprising a screw and a nut member, the displacement of which along the screw produces a change in the distance between the active portions of the jack. The jack has a catch which prevents collapse if the nut member, due to worn threads, loses its grip on the screw. The catch is achieved by dividing the nut member into a threaded load-carrying portion and a threaded portion which is axially unloaded during normal thread engagement and which follows the load-carrying portion and serves as a stop if the latter should lose its grip on the screw.

7 Claims, 5 Drawing Figures

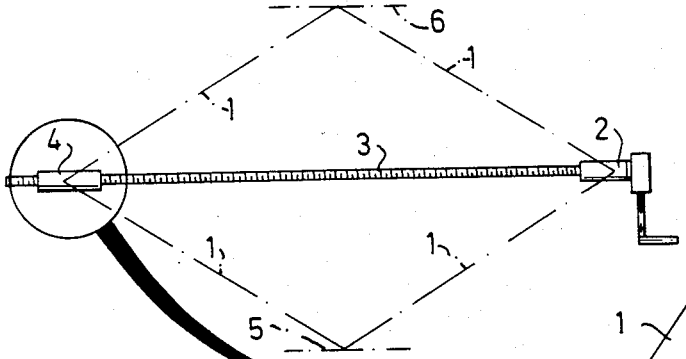
FIG.1
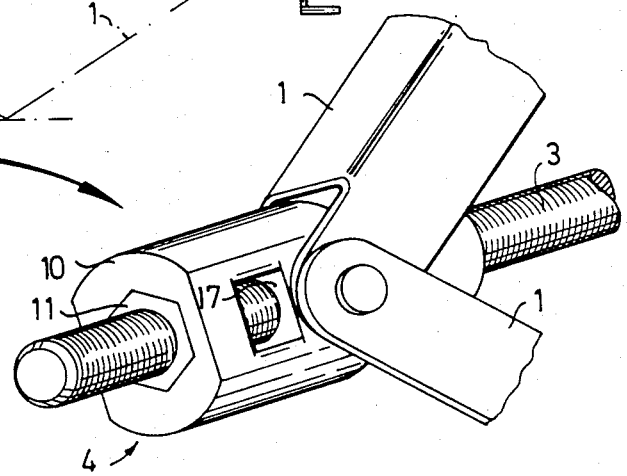
FIG. 2
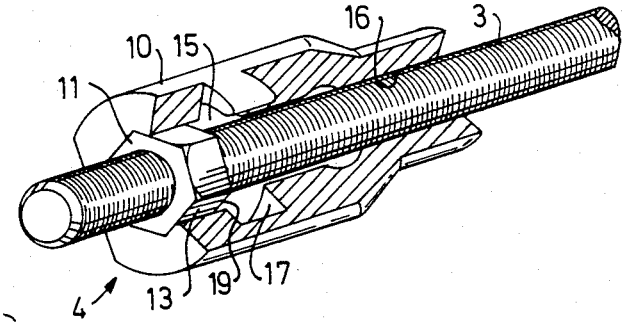
FIG. 3
FIG.5
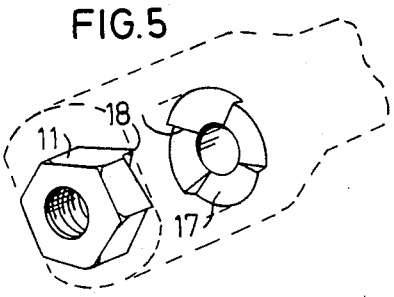
FIG. 4
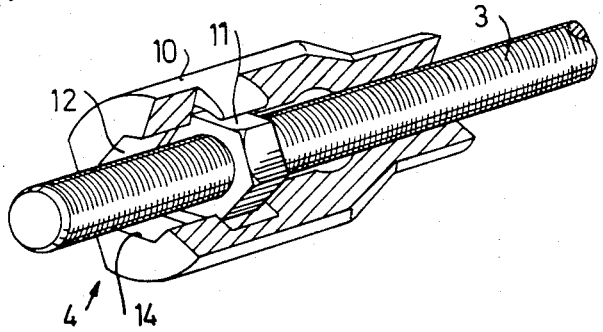

JACK

The present invention relates to a jack, comprising a threaded rod and an internally threaded nut member engaging the threads of the rod, displacement of said member along the rod as the rod is turned relative to the nut member producing a change in the distance between the active parts of the jack.

A known jack of this type consists of four links articulated to each other to form a parallelogram and a rod running diagonally between two joints and which is mounted in a bearing in one joint and engaging a nut member on which the opposite joint is mounted. The two other joints are joined to a ground support and a carrying member and form the active parts of the jack, the space between them varying when the shape of the parallelogram is changed by turning the threaded rod.

The supporting capacity of this and other types of screw jacks is entirely dependent on the engagement between the threaded portions and decreases as they wear down. It is therefore important that the threads be kept greased and clean. It is however difficult to keep vehicle jacks from becoming dirty, since they are most often used outdoors and in such a way that the threaded portions of the jack easily come into contact with contaminants such as sand and the like which cause increased wear. Neglecting to grease the jack subjects it to greater wear and to corrosion when it is stored, as is usually the case, unused for long periods of time in the vehicle baggage compartment, producing a great risk of cutting resulting in collapse when the jack is used.

The purpose of the present invention is generally to provide an automatic "safety catch" for screw jacks, which prevents collapse if the threads on the screw and/or the loaded nut are sheared off, so that the nut can slide on the screw.

This is achieved according to the invention by the nut member consisting of a load-bearing main portion and an axially unloaded portion separate therefrom, the thread of which is disposed after the thread of the main portion relative to the direction in which the nut member is moved relative to the rod to increase the distance between the active parts of the jack, and that said nut portions have firstly, interacting surfaces which during normal thread engagement between the main portion and the rod prevent rotation of the parts relative to each other but which permit axial relative movement between the parts, and secondly, axial stop surfaces facing each other which during normal thread engagement are spaced axially from each other.

When using the jack, the axially unloaded nut portion follows the load-carrying nut portion as a movable end stop. By virtue of the fact that it is unloaded, the wear thereon will be negligible in relation to the wear on the loaded or supporting nut portion. If the latter loses its grip on the screw because its threads and/or the threads of the screws have for various reasons become so worn that they cannot take the load after a certain lift, it can only fall a distance corresponding to the distance between the above-mentioned facing stop surfaces, then being caught by the axially unloaded nut portion.

In a preferred embodiment of the jack according to the invention, both portions of the nut member are made so that the surface blocking relative rotation move out of engagement with each other when the load-carrying nut fails. Thus it is not possible to increase the lifting height of the jack after failure by allowing the nut portion serving as a safety catch to assume the function of the load-carrying nut portion. Suitably, the nut portions are made in such a way that after the failure it is only possible to reduce the lift height in order to make it possible to lower a vehicle elevated with the jack. This can be done by allowing the stop surfaces to interact as a one-way clutch.

The invention will be described in more detail with reference to the example shown in the accompanying drawing, in which FIG. 1 shows a schematic side view of an embodiment of a screw jack, FIG. 2 is an enlarged perspective view of the circled area in FIG. 1, FIG. 3 is a perspective cut-away view of the nut member illustrating the relative positions of the portions during normal thread engagement, FIG. 4 is a view corresponding to FIG. 3 illustrating the relative positions of the portions after failure, and FIG. 5 is a perspective view of the nut portions interacting as a one-way clutch.

The jack shown in the drawing consists of four articulated links 1. One of the joints is mounted on a bearing 2 in which the threaded rod 3 is freely rotatably journalled. The opposite joint is arranged on a nut member which is generally designated 4, the threads of which engage the rod. The two other joints are arranged on a ground support plate 5 and a carrying plate 6, which form the active members of the jack, the distance between them being variable by rotating the rod 3 thus displacing the nut member 4 along the rod.

The nut member 4 consists of a load-carrying main portion 10 and an axially unloaded portion 11. The latter is formed by a conventional hex nut which in the normal position of the portions shown in FIGS. 2 and 3 is housed in a hexagonal hole 12 in the main portion 10. The lateral surfaces 13 of the nut 11 and the walls 14 of the hole 12 thus interact to prevent relative rotation but to permit axial relative displacement between the portions.

The hole 12 is adjacent to a cavity 15 of essentially cylindrical shape dimensioned so that the nut 11 is freely rotatable in the same.

During normal functioning of the jack, the portions 10 and 11 of the nut member 4 will be in the relative position shown in FIGS. 2 and 3, and when the distance between the active parts 5 and 6 of the jack is to be increased when lifting up a vehicle, the rod 3 is rotated so that the portions 10 and 11 are moved together to the right in the figures along the rod. If the threads 16 of the nut portion 10 are so worn that at a certain load they "lose their grip" on the rod 3, the nut portion 10 will slip to the left relative to the rod to the position shown in FIG. 4, where it is caught by the nut portion 11 when the wall 17 of the cavity 15 serving as a stop surface strikes the end surface 19 of the nut portion 11. The jack is now completely disengaged in the embodiment shown in FIGS. 2–4 because the nut 11 is freely rotatable in the cavity 15, which makes further raising or lowering impossible. In this embodiment another jack must be used in order to remove the malfunctioning jack. FIG. 5 shows a modified embodiment, in which the wall 17 of the cavity 15 and the end surface 19 of the nut portion 11 are made with ratchet teeth 18 which after failure engage each other. The teeth 18 are formed so that they permit rotation of the portions 10 and 11 relative to each other in the lifting direction, that is, the direction which causes plates 5 and 6 to move apart, but which block against relative rotation in the opposite direction. This arrangement creates a one-way clutch which blocks against further raising after failure, but which permits lowering, so that the jack can be removed without the use of another jack.

The example described above was a failure due to worn threads on the supporting portion 10 of the nut member. The arrangement according to the invention functions just as well, however, as a catch for failure caused by worn or damaged threads on the rod. This is because the nut 11 serving as a stop means lies behind the threads 16 of the load-carrying nut portion 10 and thus always engages threads on the rod, which the threads of the load-carrying nut portion have already passed and which consequently have withstood the load from the load-carrying nut portion.

The principle of the invention is of course not limited to a screw jack with links arranged in parallelogram form; rather, it can also be used in other types of screw jacks, e.g. those with a nut member displaceable along a vertical screw, and supporting means designed for example to be inserted in sleeves on the underside of a vehicle body.

What I claim is:

1. Jack, comprising an externally threaded rod and an internally threaded nut member engaging the threads of the rod, the displacement of the member along the rod as the rod is rotated relative to the nut member extending or retracting the jack, characterized in that the nut member consists of a threaded load-carrying main portion and a threaded axially unloaded portion separate therefrom, the thread of said axially unloaded portion being disposed after the thread of the main portion, as viewed when the nut member is moved relative to the rod to extend the jack, and that said main and unloaded nut portions have, firstly, interacting surfaces which during normal thread engagement between the main portion and the rod prevent rotation of said main and unloaded portions relative to each other but which permit axial relative movement between said main and unloaded portions, and secondly, axial stop surfaces facing each other, which during normal thread engagement are spaced axially from each other, said main and unloaded portions of the nut member being so arranged that said surfaces preventing relative rotation are out of contact with each other when the stop surfaces are in contact.

2. Jack according to claim 1, characterized in that the stop surfaces are made so that when in contact with each other they permit rotation of said main and unloaded portions of the nut member relative to each other in both directions.

3. Jack according to claim 1, characterized in that the stop surfaces are made so that when in contact with each other they form a one-way clutch, which permits rotation of the main portion relative to the unloaded portion in the direction which results in retracting the jack, and which blocks against relative rotation in the opposite direction.

4. Jack according to claim 3, characterized in that the stop surfaces are made with interacting ratchet teeth engaging in one direction.

5. Jack according to claim 1, characterized in that the main portion of the nut member has a cavity in which the axially unloaded portion is housed, said cavity having a first portion with an inner contour which prevents rotation of the axially unloaded portion relative to the main portion, and a second portion located in front of said first portion, with an inner contour which permits rotation of the axially unloaded portion relative to the main portion.

6. Jack according to claim 5, characterized in that the axially unloaded portion is a hex nut, that the first portion of the cavity has a corresponding hexagonal inner contour, and that the second portion of the cavity is cylindrical with an inner diameter greater than the diameter of the circle circumscribing the hex nut.

7. Jack according to claim 1, characterized in that the threaded rod forms a diagonal in a parallelogram formed by four links articulated to each other, one of the articulations being a bearing for the rod, and the diagonally opposite articulation being disposed on the nut member.

* * * * *